US006799941B2

(12) United States Patent
Uffelman

(10) Patent No.: US 6,799,941 B2
(45) Date of Patent: Oct. 5, 2004

(54) TURBINE FUEL PUMP AND METHOD FOR CALIBRATING

(75) Inventor: Bradley L. Uffelman, Caro, MI (US)

(73) Assignee: TI Group Automotive Systems, L.L.C.

( * ) Notice: Subject to any disclaimer, the term of this patent is extended or adjusted under 35 U.S.C. 154(b) by 0 days.

(21) Appl. No.: 10/174,924

(22) Filed: Jun. 19, 2002

(65) Prior Publication Data

US 2003/0185668 A1 Oct. 2, 2003

Related U.S. Application Data

(60) Provisional application No. 60/367,679, filed on Mar. 26, 2002, and provisional application No. 60/371,237, filed on Apr. 9, 2002.

(51) Int. Cl.[7] ..... F04D 5/00
(52) U.S. Cl. ..... 415/55.4
(58) Field of Search ..... 415/55.1–55.6, 415/118, 121.3, 173.1–173.3; 417/423.3

(56) References Cited

U.S. PATENT DOCUMENTS

| | | | | | |
|---|---|---|---|---|---|
| 763,525 | A | * | 6/1904 | van Beresteyn | 418/127 |
| 1,211,831 | A | * | 1/1917 | Edwards | 415/55.4 |
| 1,418,041 | A | * | 5/1922 | Trane | 415/55.4 |
| 2,247,335 | A | * | 6/1941 | Neibert | 415/55.4 |
| 3,257,955 | A | * | 6/1966 | Worst | 415/55.4 |
| 3,734,638 | A | * | 5/1973 | Ebsary | 415/55.4 |
| 5,257,916 | A | | 11/1993 | Tuckey | 417/423.3 |
| 6,068,456 | A | | 5/2000 | Tuckey et al. | 417/423.3 |
| 6,227,819 | B1 | | 5/2001 | Gettel et al. | 417/423.1 |
| 6,231,318 | B1 | * | 5/2001 | Cotton et al. | 415/55.1 |

* cited by examiner

*Primary Examiner*—Edward K. Look
*Assistant Examiner*—Richard Edgar
(74) *Attorney, Agent, or Firm*—Reising, Ethington, Barnes, Kisselle, P.C.

(57) ABSTRACT

A turbine fuel pump assembly draws fuel from a reservoir and supplies that fuel to a combustion engine. The assembly includes an electric motor which drives a fuel pump, all of which is supported in a sleeve. The fuel pump has a guide ring which has a stripper segment for stripping or shearing fuel off of the vanes of an impeller and redirecting the fuel through an outlet port of the fuel pump. The turbine fuel pump assembly can be easily calibrated for improved pumping efficiency via a calibration ring tool which plastically deforms the sleeve externally by producing a dimple upon the sleeve and a corresponding interior protuberance which bears radially inward against a trailing segment of the guide ring to calibrate or move the cantilevered stripper segment against the impeller to a point where fuel stripping is improved and flow through the pump is optimized.

31 Claims, 6 Drawing Sheets

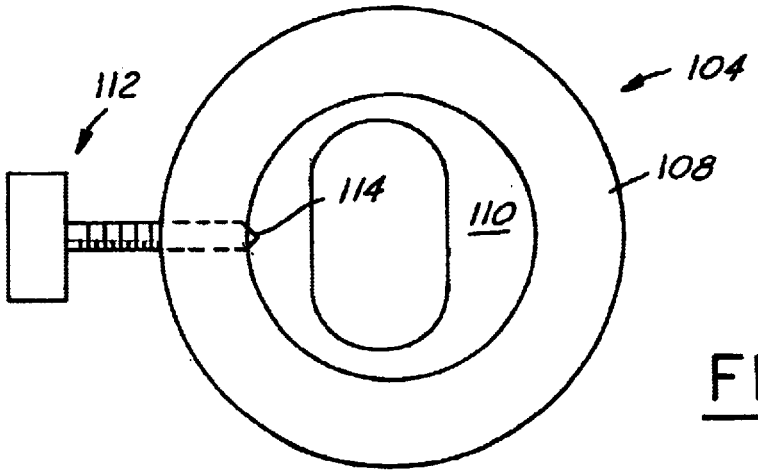
FIG. 8
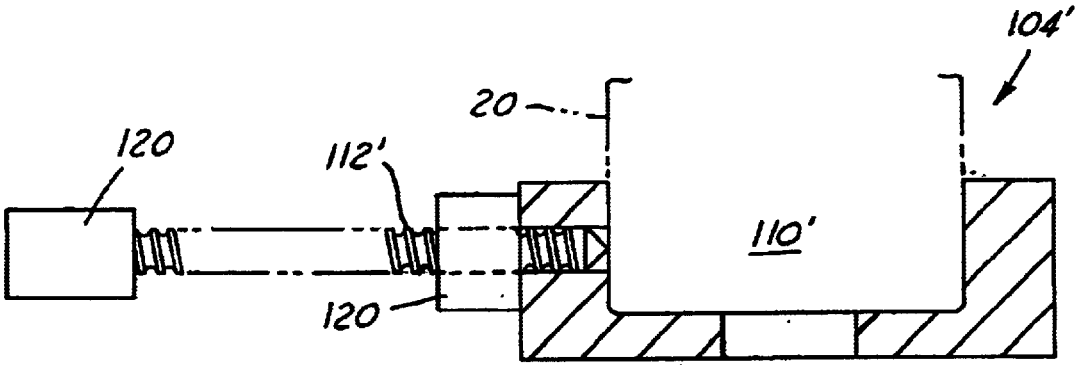
FIG. 9
| 11 Volt @ 400 KPa | | | | | | |
|---|---|---|---|---|---|---|
| | Before Calibration Ring | | | After Calibration Ring But Before Break-In | | |
| Pump # | Flow (LPH) | Current (AMPS) | Speed (RPM) | Flow (LPH) | Current (AMPS) | Speed (RPM) |
| 105882 | 115.50 | 6.09 | 7300 | 127.50 | 6.26 | 7200 |
| 105884 | 117.50 | 6.45 | 7000 | 120.00 | 6.83 | 6900 |
| 105886 | 104.00 | 6.19 | 6600 | 106.00 | 6.54 | 6500 |
| 105887 | 110.00 | 5.64 | 6850 | 114.00 | 6.00 | 6750 |
| 105888 | 87.00 | 6.08 | 6550 | 118.50 | 6.40 | 6800 |
| 105891 | 112.00 | 6.18 | 7250 | 119.00 | 6.53 | 7100 |
| 105892 | 120.00 | 6.55 | 7050 | 121.00 | 6.81 | 6950 |
| MIN | 87.00 | 5.64 | 6550 | 106.00 | 6.00 | 6500 |
| MAX | 120.00 | 6.55 | 7300 | 127.50 | 6.83 | 7200 |
| AVERAGE | 109.43 | 6.17 | 6943 | 118.00 | 6.48 | 6886 |
| STDS. | 11.20 | 0.29 | 294 | 6.64 | 0.30 | 232 |
FIG. 10

TURBINE FUEL PUMP AND METHOD FOR CALIBRATING

REFERENCE TO RELATED APPLICATIONS

Applicant claims priority of provisional applications, Ser. No. 60/367,679, filed Mar. 26, 2002, and Ser. No. 60/371,237, filed Apr. 9, 2002.

TECHNICAL FIELD OF THE INVENTION

This invention relates generally to a fuel pump and more particularly to a turbine type fuel pump and method for calibrating the same.

BACKGROUND OF THE INVENTION

Electric motor driven turbine type fuel pumps are customarily used in automotive engine fuel delivery systems and the like. These pumps typically include a housing adapted to be immersed in a fuel supply tank with an inlet for drawing liquid fuel from the surrounding tank and an outlet for supplying fuel under pressure to the engine. The electric motor drives a pump impeller with an array of circumferentially spaced vanes about the periphery of the impeller. An arcuate pumping channel, with an inlet port and an outlet port at opposed ends surrounds the impeller periphery for developing fuel pressure through a vortex-like action on liquid fuel in pockets formed by the impeller vanes and the surrounding channel. One example of a fuel pump of this type is illustrated in U.S. Pat. No. 5,257,916, and two other examples are U.S. Pat. No. 6,227,819 B1 and U.S. Pat. No. 6,068,456, all three being incorporated herein by reference.

Typically, the impeller type turbine fuel pumps have guide rings which strip the fuel from the impeller vanes thereby diverting the fuel through an outlet port. The channel is carried radially between the impeller and a substantial portion or trailing segment of the guide ring. A smaller portion or stripper segment of the guide ring is disposed circumferentially between the inlet and outlet ports and is closely orientated to the impeller for stripping the moving vanes of high pressure fuel, thereby preventing the fuel at the outlet port from bypassing the fuel pump outlet and exiting back into the low pressure inlet port.

Despite significant improvements in the design and construction of turbine type fuel pumps, they are generally very inefficient with an efficiency of generally between about 20% to 40%, and when combined with a typical electric motor having an efficiency of about 45% to 60%, the fuel pumps have an overall efficiency of between about 15% to 30%. Any fuel bypass from the high pressure outlet port back into the low pressure inlet port will contribute to this inefficiency. Moreover, under heated fuel conditions, the efficiency is significantly impaired even further.

SUMMARY OF THE INVENTION

A turbine fuel pump assembly draws fuel from a reservoir and supplies that fuel to a combustion engine. The assembly includes an electric motor which drives a fuel pump, all of which is supported in a sleeve. The fuel pump has a guide ring which has a stripper segment for stripping or shearing fuel off of the vanes of an impeller and redirecting the fuel through an outlet port of the fuel pump. The turbine fuel pump assembly can be easily calibrated for improved pumping efficiency via a calibration ring tool which plastically deforms the sleeve externally by producing a dimple upon the sleeve and a corresponding interior protuberance which bears radially inward against a trailing segment of the guide ring to calibrate or move the cantilevered stripper segment against the impeller to a point or location where fuel flow through the pump is optimized.

The impeller is mounted rotatably between an upper and lower cap of the housing. The guide ring which circumferentially surrounds the impeller is also disposed between the upper and lower caps but is held stationary with respect to the housing. An outward side of the guide ring faces the surrounding sleeve so that a protuberance disposed directly between the outward side of the guide ring and the surrounding sleeve biases the cantilevered stripper segment toward the impeller vanes for improved shearing of fuel off the rotating impeller.

Preferably, the stripper segment of the guide ring is engaged unitarily between an impact segment which partially defines a high pressure fuel outlet port, and a trailing segment which extends circumferentially beyond a low pressure fuel inlet port of the housing. Preferably, the guide ring is split by a slit defined circumferentially between the impact segment and distal end of the trailing segment. The stripper segment is thus cantilevered with respect to the trailing segment so that the protuberance, created during the calibration process, pushes against the trailing segment at a location near the inlet port and the stripper segment, causing the stripper segment to cantilever or move radially inward against the impeller. Preferably, the protuberance is unitary to and projects radially inward from the sleeve.

Objects, features and advantages of this invention include a turbine fuel pump assembly that has a significantly improved efficiency and a method of calibration utilizing a novel calibration ring tool to gain such improved efficiencies. The invention may be readily incorporated into and/or performed on existing fuel pump designs, increases fuel output flow at cold and hot fuel temperatures, is of relatively simple design and economical manufacture and assembly and in service has a significantly increased useful life.

BRIEF DESCRIPTION OF THE DRAWINGS

These and other objects, features and advantages of this invention will be apparent from the following detailed description of the preferred embodiments and best mode, appended claims and accompanying drawings in which:

FIG. 8 is a top view of the calibration ring tool;

FIG. 9 is a cross sectional view of a second embodiment of a calibration ring tool;

FIG. 10 is a table of test results showing pump performance data before and after calibrations conducted with the calibration ring tool;

DETAILED DESCRIPTION OF THE EMBODIMENTS

Figure 1:
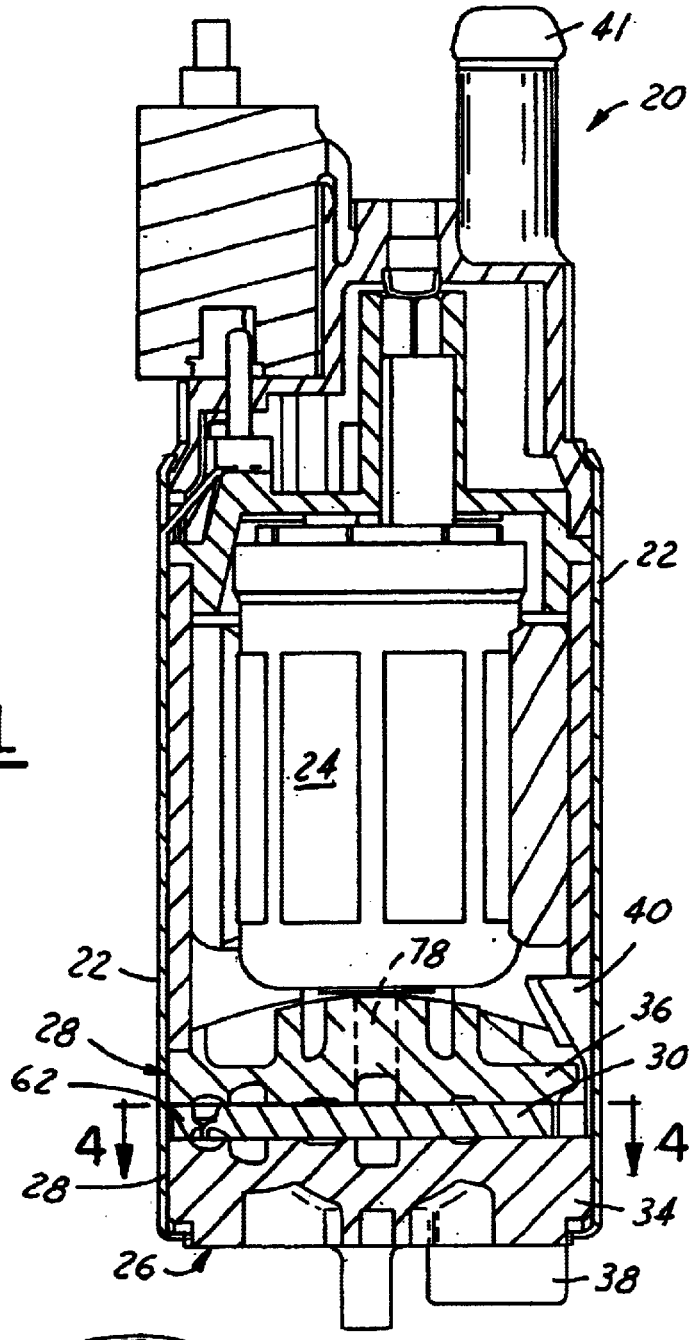
FIG. 1 is a longitudinal cross sectional view of a turbine fuel pump assembly in accordance with the present invention.
Figure 2:
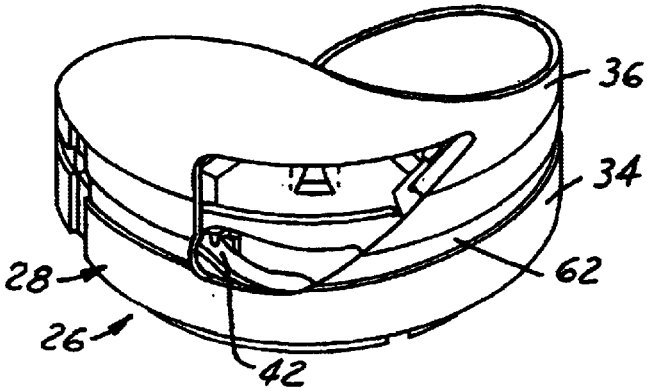
FIG. 2 is a perspective view of a fuel pump of the fuel pump assembly.
Figure 3:
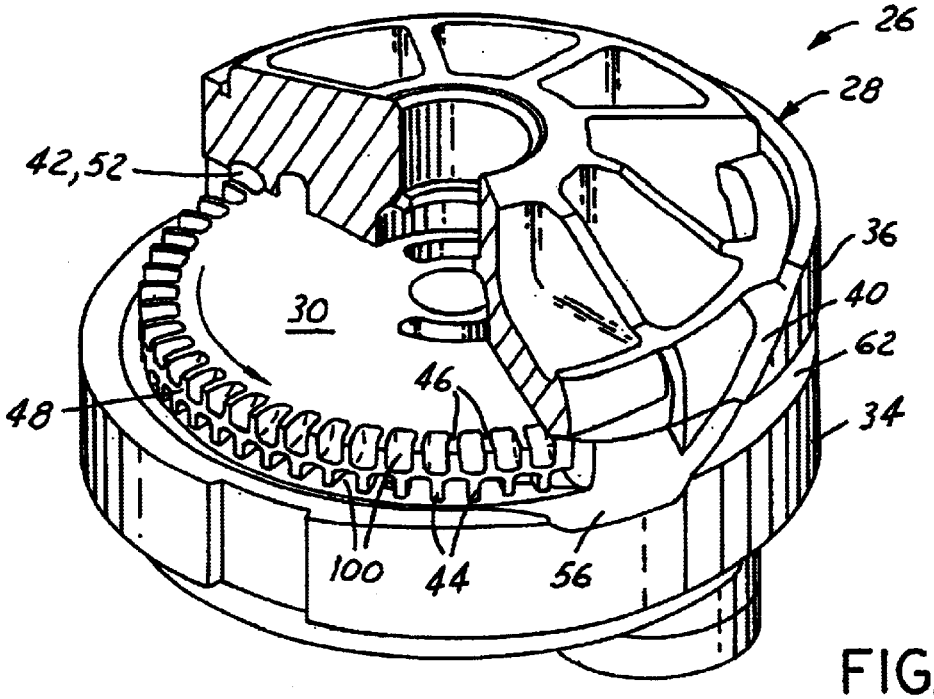
FIG. 3 is a perspective view of the fuel pump with a portion of an upper cap removed to show internal detail.

Referring to FIGS. 1–3, an electric motor fuel pump assembly 20, mounted within a fuel tank of a combustion engine vehicle (not shown), has a substantially cylindrical outer sleeve or encasement 22 which concentrically houses an electric pump motor 24 which powers a turbine fuel pump 26 in accordance with the present invention. The turbine fuel pump 26 is received in and surrounded by the sleeve 22 below the motor 24 and includes a two part housing 28. An impeller 30, shaped substantially like a flat disk, is rotated within an impeller cavity 32 by the motor 24. The cavity 32 is defined axially between lower and upper caps 34, 36 of the housing 28 and radially by the sleeve 22. The lower cap 34 carries a fuel inlet passage 38 which flows low pressure fuel upward from a fuel reservoir or tank to the cavity 32, and the upper cap 36 carries a fuel outlet passage 40 which redirects and flows high pressure fuel substantially upward out of the cavity.

Figure 4:
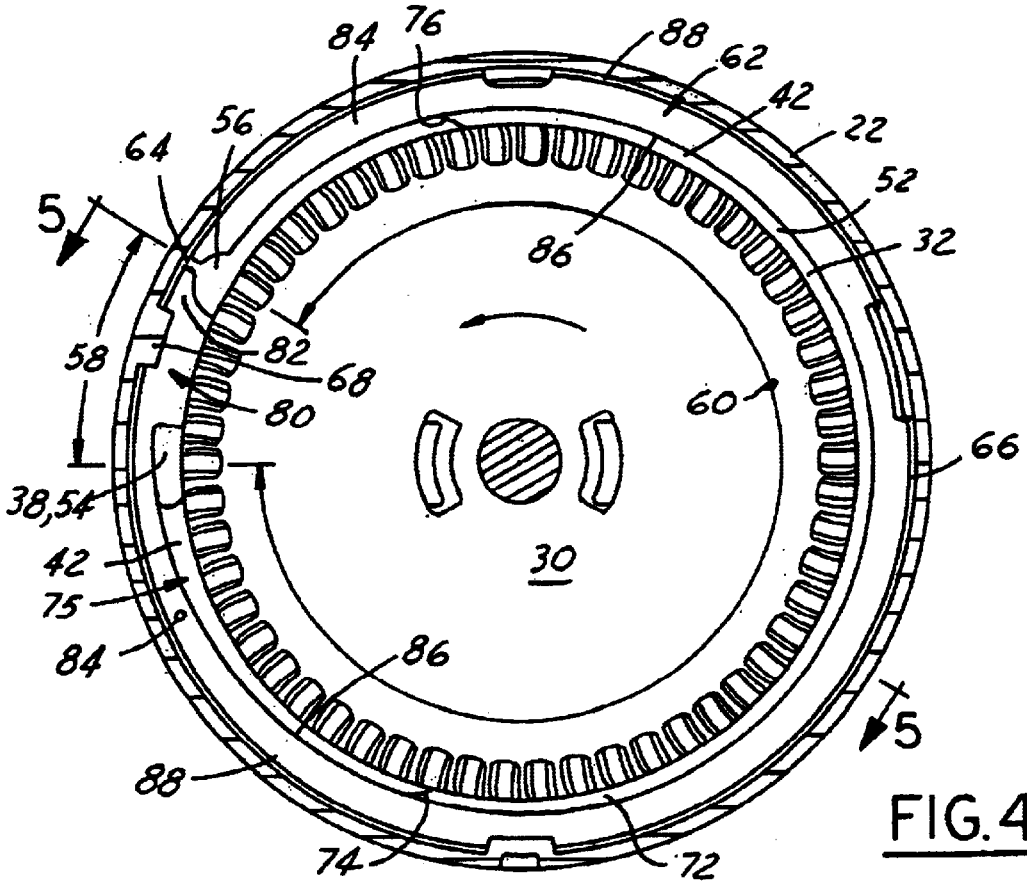
FIG. 4 is a lateral cross sectional view of the turbine fuel pump assembly taken along line 4—4 of FIG. 1.

Referring to FIG. 4, the impeller 30 moves the fuel within an arcuate pumping channel 42 via a circumferential lower and upper arrays of vanes 44, 46 each projecting radially outward from and spaced circumferentially about impeller 30. The lower array of vanes 44 are exposed to a lower groove 50 of the channel 42 which is carried by the lower cap 34, and likewise, the upper array of vanes 46 are exposed to an upper groove 52 of the channel 42 which is carried by the upper cap 36. The lower and upper array of vanes 44,46 are partially supported by and separated from each other by a circumferential rib 48 projecting radially outward from the impeller 30 and meeting flush with the distal ends of the vanes 44, 46. An inlet port 54 of the inlet passage 38 is disposed at one end of the lower groove 50 of the channel 42, and an outlet port 56 of the outlet passage 40 is located at the other end of the channel 42 and carried by the upper groove 52.

The inlet and outlet ports 54, 56 are generally separated circumferentially from one-another by a circumferential first distance or angular displacement 58 which is substantially shorter than a diametrically opposing circumferential second distance or angular displacement 60, as best shown in FIG. 4. The pumping channel 42 substantially surrounds the impeller 30 and co-extends with the second distance 60, but does not co-extend with the shorter first distance 58.

Figure 5:
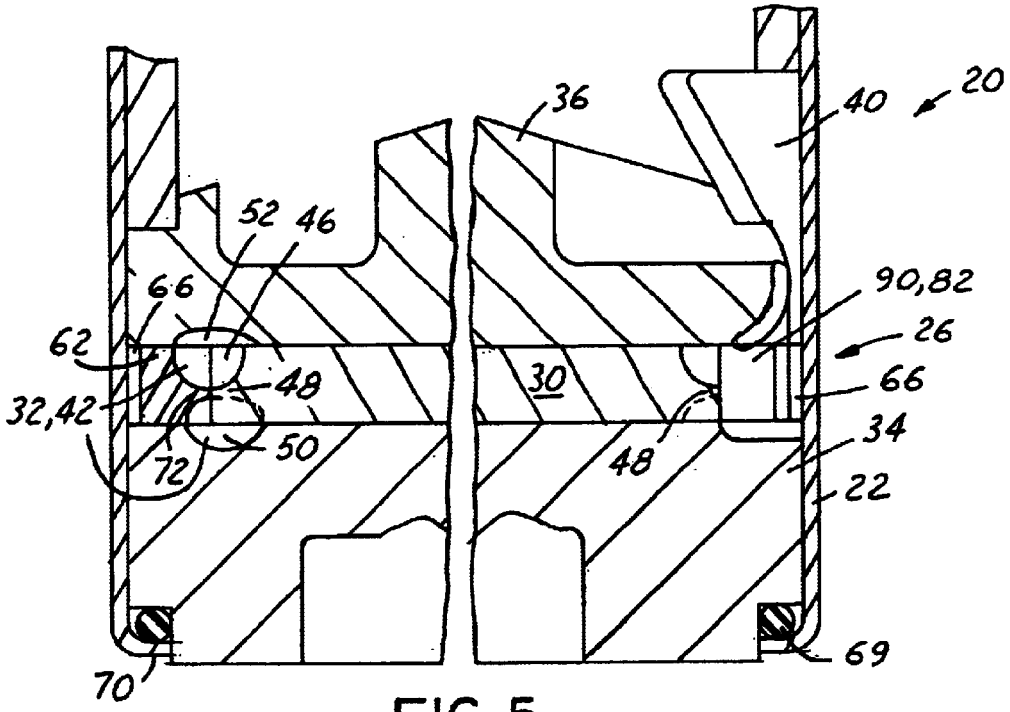
FIG. 5 is an enlarged partial cross sectional view of the turbine fuel pump assembly taken from FIG. 1.

A guide ring 62 assures minimal loss of fuel as the fuel flows from the low pressure inlet port 54 to the high pressure outlet port 56. The guide ring 62 seats within the impeller cavity 32 and seals between the lower and upper caps 34, 36 of the housing 28. During initial assembly, and because the outer diameter of the impeller 30 is slightly greater than the inner diameter of the guide ring 62, the guide ring has a split or slit 64 so that it can be radially expanded to compressibly or snap fit about the impeller 30. The degree of radial expansion of the guide ring 62 is dependent upon the tolerance range of the diameter of the impeller 30 and the guide ring 62. Because the guide ring 62 expands radially with varying tolerance of the impeller 30, an annular clearance 66 is defined radially inward to, the sleeve 22 permitting radial expansion of the guide ring. For the sake of explanation, the Walbro TI 78 Turbine Pump model, has an impeller diameter tolerance held within fifty microns, however, this tolerance may change between varying pump models and applications. To adjust for the tolerance, the annular clearance 66 has an average radial width of approximately at least twenty-five microns (assuming an average diameter of the TI 78 impeller). With the guide ring 42 expanded or slightly press fitted about the impeller 30, the guide ring and impeller are together placed into the impeller cavity 32 and rotationally or arcuately orientated via a key interface 68. As shown in FIG. 5, the bottom of the lower cap 34 is sealed against a resilient gasket or O-ring 69 disposed axially and compressibly between the periphery of the lower cap 34 and a radially inward extending shoulder 70 of the sleeve 22.

The guide ring 62 has a circumferential rib 72 which projects radially inward toward the rib 48 of the impeller 30 and defines in-part the lower and upper grooves 50, 52 of the channel 42. During assembly of the pump assembly 20, it is the rib 72 of the guide ring 62 which snap fits about the rib 48 of the impeller 30. Rib 72 extends circumferentially or arcuately with an angular range of greater than 180 degrees, and preferably within a range of 240 to 270 degrees, along the second distance 60 from a downstream end 74 of the rib 72 disposed adjacent a low pressure section 75 of the channel 42 and upstream of the inlet port 54 to a high pressure or upstream end 76 of the rib 72 disposed adjacent a high pressure section of the channel 42 and downstream of the outlet port 56.

To optimize concentric orientation of the impeller rib 48 to the ring rib 72 thereby assuring minimal friction between the ribs as the impeller 30 rotates, during initial break-in of the pump assembly 20, the guide ring 62 is free to move laterally between the lower and upper caps 34, 36 of the housing 28. The guide ring 62 remains free as a shaft 78 of the motor 24 (as best shown in FIGS. 1 and 4) is inserted concentrically into the impeller 30 and the various components center themselves accordingly. The shaft 78 is inserted into the impeller 30 after the housing 28, the guide ring 62 and the impeller 30 are placed as a unit within the sleeve 22. It is only after the lower and upper caps 34, 36 are compressed axially against the guide ring 62 within the sleeve 22, and butting against the O-ring 69 and shoulder 70, that the guide ring 62 seats and seals directly between the lower and upper caps 34, 36.

Figure 6:
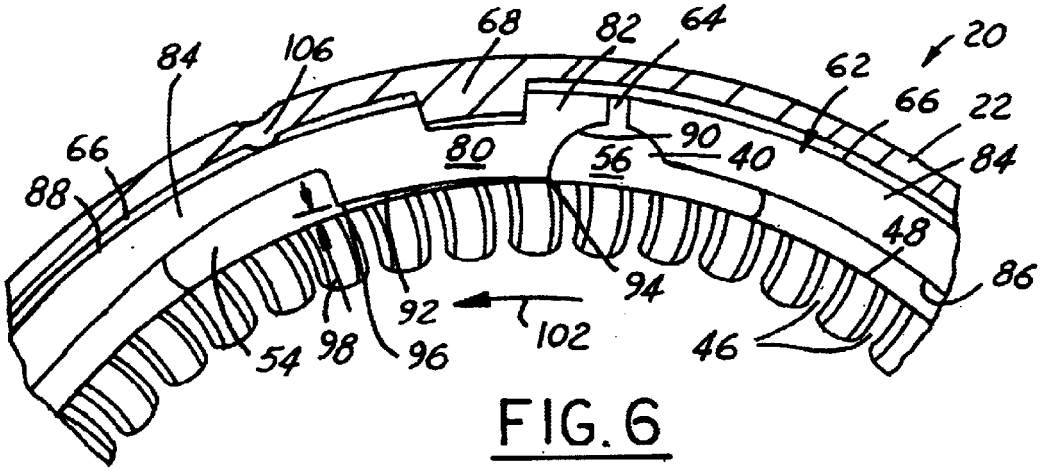
FIG. 6 is an enlarged partial cross sectional view of the turbine fuel pump assembly taken from a circle of FIG. 4.

Referring to FIGS. 4 and 6, to minimize fuel bypass leakage, the slit 64 of the guide ring 62 is disposed at or near the outlet port 56. The clearance 66 is therefore exposed to the high pressure fuel at the fuel outlet passage 40. With the guide ring 62 held stationary by the lower and upper caps 34, 36, initial rotation of the impeller 30 will experience some frictional resistance by the guide ring 62, however, continued rotation will break-in and free-up the revolving interface between the guide ring 62 and the impeller 30. That is, once broken-in, the impeller rotates with respect to the guide ring without friction and with a fluid seal or "bearing" between them.

The guide ring 62 has a stripper segment 80 engaged unitarily with the impeller 30 and circumferentially between an impact segment 82 and a trailing segment 84 of the guide ring. The stripper segment 80 extends along the first distance 58 between the inlet and outlet ports 54, 56. The trailing segment 84 of the guide ring has a circumferential inward side 86 which defines the radial outward boundary of the channel 42, and the guide ring which includes the trailing segment has a circumferential outward side 88 which defines the radial inward boundary of the clearance 66. The clearance 66 assures that the metallic sleeve 22 does not contact and distort the concentricity of the guide ring 62 with the impeller 30. Such distortion would impair rotation of the impeller 30 and cause fuel leaks within the fuel pump 26. The clearance is thus sized to take into account the diametric tolerance of the impeller 30 during the manufacturing process. The rib 72 projects radially inward from the inward side 86 of the trailing segment 84 which co-extends along the second distance or angular displacement 60 from the stripper segment 80 at the inlet port 54 to the slit 64 at the outlet port 56, as best shown in FIG. 4. The impact segment 82 defines in-part the outlet port 56 and the outlet passage 40, and extends from the stripper segment 80 to the slit 64. An impact wall or ramp 90 carried by the impact segment 82 of the guide ring 62 redirects the tangential high pressure fuel flow exiting the outlet port 56 to an upward or axial direction. The flow velocity of the high pressure fuel hitting the convex shape of the impact wall 90 tends to urge the stripper segment 80 away from the impeller 30, however, the friction created by the clamping force of the caps 34, 36 against the impeller 30 is great enough to resist this radial outward movement tendency of the stripper segment 80. If the stripper segment were able to move radially outward, the stripping or shearing of fuel from the impeller vanes would be greatly impaired.

A stripper surface 92 of the stripper segment 80 extends axially across both the lower and upper vanes 44, 46 of the rotating impeller 30 and diverts the fuel onto the impact ramp 90 of the impact segment 82. The stripper surface 92 faces radially inward and substantially conforms to the radius of-the impeller 30, and has a leading edge 94 which contiguously forms part of the impact ramp 90 and a trailing edge 96 which is slightly spaced radially outward from the impeller 30 thereby creating a minimal running gap 98. Every two circumferentially adjacent vanes of the two arrays 44, 46 define a fuel pocket 100 which communicate with the passages 38, 40 and channel 42. The surface area of the stripper surface 92 covers approximately four fuel pockets 100 on each face of the impeller 30 as it rotates in the direction of arrow 102.

Ideally, and to optimize stripping efficiency, a maximum area of the stripper surface 92 is in close contact with the impeller 30. However, because of varying impeller size and the pivoting movement of the cantilevered stripper segment 80 the running gap 98 is required and will vary somewhat in radial distance depending upon the diametric tolerance range of the impeller 30, the guide ring 62, and pump wear. In effect, the running gap 98 assures that the leading edge 94 is always in close contact with the impeller 30, and not the trailing edge 96. Otherwise, the high pressure fuel would overcome the friction created by the clamping force of the caps 34, 36 against the impeller 30 and lift the stripper segment 80 off or away from the impeller 30, by hydraulic force, preventing or greatly impairing stripping of the fuel from the impeller 30. If the fuel is not stripped from the distal ends of the vanes 44, 46 at the outlet port 56, the high pressure fuel will continue to move with the impeller 30 from the outlet port 56 proximity, along the first distance 58, and to the inlet port 54 (i.e. bypassed). Sizing of the running gap 98 takes into account the varying diametric size of the impeller 30 along with minor wear of the stripper surface 92 at and near the leading edge 94. Therefore, the radial distance of the running gap 98 at the trailing edge 96 is less than the radial distance of the clearance 66 and gradually decreases in the circumferential direction toward the leading edge 94.

Any wear of the stripper surface 92, with the pump assembly 20 running, is minor because the vanes 44, 46 and the rib 48 are "wetted" by the fuel providing a fuel film or "bearing" between the leading edge 94 of the stripper surface 92 and the impeller 30. This film only has a thickness of approximately ten angstroms and thus does not contribute toward any tendency of the stripper segment 80 lifting radially outward away from the impeller 30 as previously described.

Figure 7:
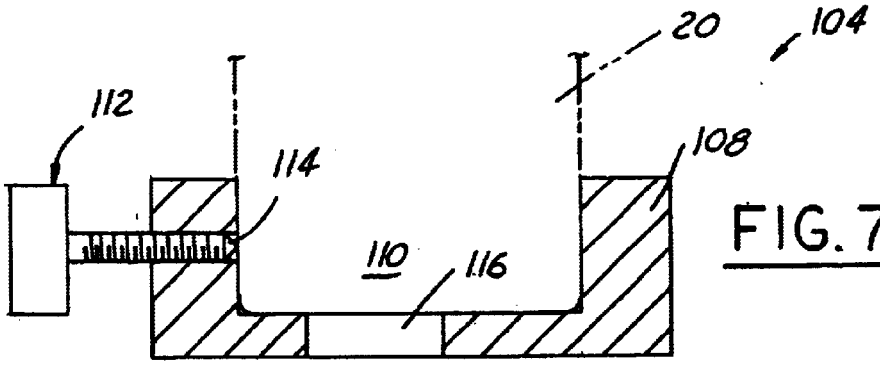
FIG. 7 is a cross sectional view of a calibration ring tool in accordance with the present invention.

As previously described, positioning of the stripper surface 92 is paramount for optimizing pump efficiency. This efficiency can be improved while the pump assembly 20 is running via use of a calibration ring tool 104 (as best shown in FIGS. 7 and 8) which creates a protuberance 106 on the interior surface of the sleeve 22 and a corresponding dimple on the exterior surface of the sleeve 22. The sleeve 22 is made of metal or a variety of other materials capable of plastic or permanent deformation such as aluminum or stainless steel. The protuberance 106 projects radially inward through the clearance 66 and contacts the outward side 88 of the trailing segment 84 near the stripper segment 80 of the guide ring 62. The radially inward directed force of the tool 104 creates the protuberance 106 which must move the cantilevered stripper segment 80 radial inward toward the impeller 30 just enough to maximize the fuel flow output. The protuberance must overcome the frictional resistance to radially inward movement of the stripper segment 80 produced by an axial force of approximately two hundred pounds of clamping load which compresses the guide ring 62 between the two caps 34, 36.

The tool 104 has a base 108 with a bore 110 that conforms to the bottom shape and outside diameter of the pump assembly 20 to slideably receive the bottom end of the pump assembly therein. With the pump assembly 20 running and disposed within the bore 110, a calibration screw 112 which is adjustably threaded laterally through the base and into the bore 110 has a pointed end or tip 114 which presses or impinges upon the exterior surface of the sleeve 22 thus plastically permanently deforming the sleeve 22 and creating the dimple and corresponding protuberance 106 with continued turning of the screw 112 to advance it. The tighter the tolerance of clearance between the stripper segment 80 and the distal ends of the vanes 44, 46, the better the shearing or diverting of fuel to the outlet which results in less fuel being bypassed from the outlet port 56 to the inlet port 54, therefore the higher the efficiency of the fuel pump assembly 20.

The calibration procedure utilizing the calibration ring tool 104 requires the pump assembly 20 to be inserted axially into the base 108 of the tool 104. The pump assembly 20 is then rotated so that a pre-defined location or marking on the pump assembly 20, such as the inlet passage 38 rotationally aligns to an alignment mark on the tool 104. The calibration screw 112 is then turned only slightly so that the tip 114 engages the sleeve 22, but only enough to hold the pump assembly 20 in this aligned position in the ring tool 104. The pump assembly 20 together with the tool 104 is then installed, or is pre-disposed, on a test stand or flow rack having a fuel pool which directly communicates with the inlet passage 38 through an opening 116 through the ring tool 104. The rack has instrumentation and pressure regulators for measuring and monitoring current draw and output flow of the fuel pump assembly 20 at a pre-established constant voltage and operating pressure such as 11 volts and 400 kPa. While the pump assembly 20 is running, the current draw is monitored as the calibration screw 112 is slowly turned inward (increasing the projection of the dimple) until the amperage of the current increases by about 0.3 to 0.5 amps or increases about 3% to 8% and preferably 4% to 7%. Current increase is dependent upon the turbine fuel pump model and varies somewhat from one pump assembly to another of the same model. Once the current increase is obtained, turning or advancing of the screw 112 is stopped. The screw 112 is loosened or retracted and the pump assembly 20 is removed from the rack and the tool 104. It should be expected that the current draw upon the motor 24 of the fuel pump assembly 20 will increase and the pump speed will decrease with increasing flow due to higher torque caused from a tighter stripper to impeller interface and the increased fuel flow rate or output.

FIG. 10 is a table depicting the results of such a calibration method for seven pump samples utilizing at room temperature a standard soddard liquid simulating the characteristics of gasoline except that it is inflammable and before pump break-in. After pump break-in, typically twenty-four hours of operation a vehicle application with gasoline, the current draw will decrease and the pump speed will increase back to their initial values before calibration, however, the output fuel flow rate at ambient temperature will increase further by another 2% to 7%. For the Walbro T1.78 Turbine Pump Model, total flow improvement after calibration and break-in is approximately 13% at fuel normal operating temperatures, and flow improvement for hot fuel is approximately 40%. Of course these values are dependent upon the pre-calibration condition of the pump.

It is also possible to improve pump efficiency by adjusting the screw 112 radially inward while monitoring and optimizing fuel flow, instead of current draw. The screw 62 is simply advanced or turned slowly inward until the maximum fuel flow crests (declines slightly just after increasing), at which point advancement of the calibration screw 112 is stopped and the screw is retracted. The flow monitoring method is not necessarily ideal because a flow meter must monitor pressure pulses which directly relate to the number of vanes on the impeller. Measuring current is therefore quicker and easier than measuring flow.

The pump calibration process can be further refined via automation and production line racks capable of supporting a series of pump assemblies 20 (not shown). Referring to FIG. 9, for example, each rack supports a series of a second embodiment of the calibration ring tool 104' and a single pool of fuel from which the inlet passages 38 of each pump assembly 20 draws fuel. Depressing a single control palm button can lower a head having a series of rubber grommets which secure to upward extending nozzles 41 that communicates with the outlet passages 40 of the pump assemblies 20, as best shown in FIG. 1. With the fuel flow test loop established via the rack head and lead wires of the rack connected to each of the pump assemblies 20, the automated calibration test can begin. Such a process may first perform a self priming pump test, a pre-calibration flow performance test at a given voltage and pressure, a pressure relief test which actuates an over pressure relief feature on the pump assembly (not shown), and a noise test utilizing noise sensors.

The manual or thumb screw 112 of the tool 104 is replaced with a ball screw 112' driven by a servo motor 120. After the pre-testing is complete the automated calibration process may begin. A controller electrically communicates with the servo motors 120 moving the screw 112' inward until a pre-established current increase is reached by the pump motor 24. The servo motor 120 then automatically reverses the direction of rotation to retract the screw 112 and release the pump assembly 20 from the tool 104'. The new flow rate is automatically recorded and the pump assemblies 20 which passed the flow test are stamped and evacuated of fuel, via some vacuum source associated with the rack, for shipment. The rack opens, or the rack head automatically rises so the pump assemblies 20 can be removed. The automated pre-testing and calibration process may take approximately thirty seconds to conduct.

Figure 11:
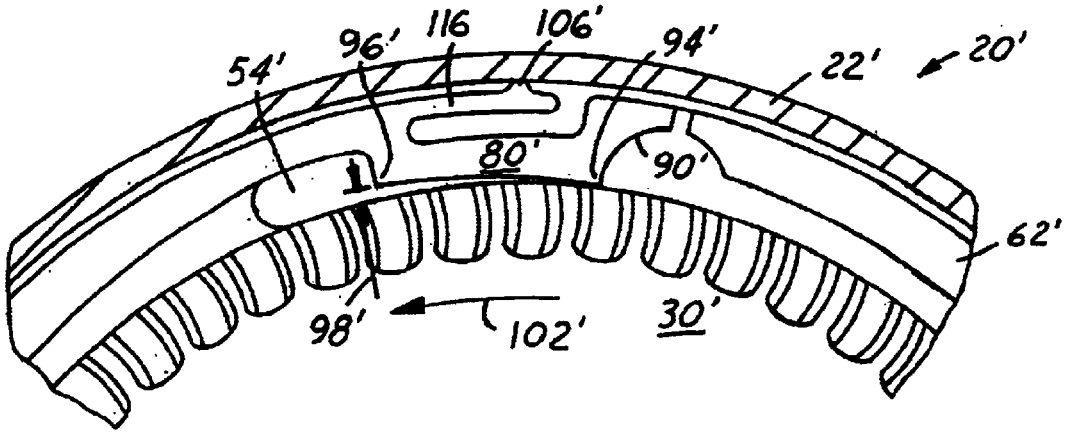
FIG. 11 is a partial cross section of a second embodiment of a fuel pump assembly similar in perspective to FIG. 6.

Referring to FIG. 11, a second embodiment of a pump assembly 20' is shown. The protuberance 106 of the first embodiment is essentially relocated onto a molded cantilevered finger 116 which projects circumferentially on the outside of a stripper segment 80' of a guide ring 62'. The protuberance 106' of the second embodiment projects radially outward from and extends laterally of the finger 116 to engage the sleeve 22' producing a controlled radial force created by the resilient deflection of the finger 116 during assembly of the fuel pump assembly 20'. The inward deflection of the finger 116 causes a leading edge 94' to generally contact the impeller 30' at a substantially constant contact force while maintaining a running gap 98' between a trailing edge 96' of a stripper surface 92' and the impeller 30'.

Figure 12:
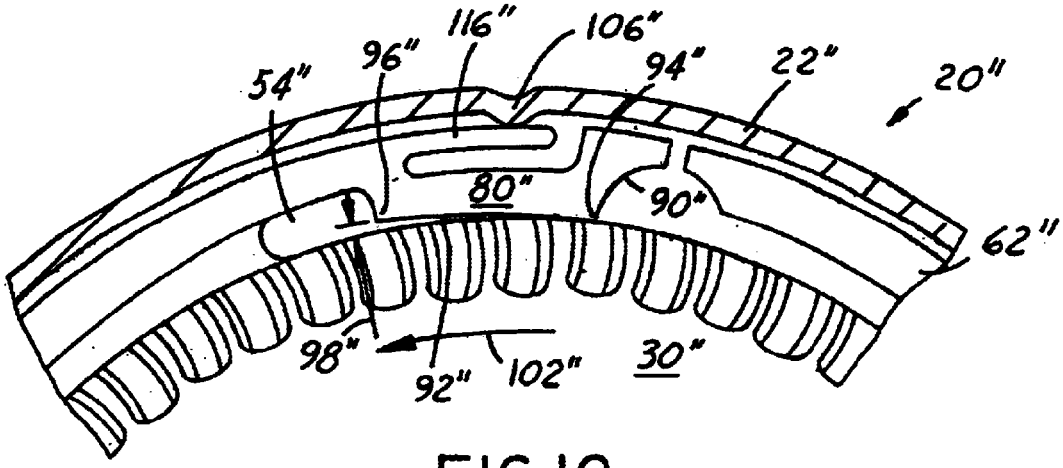
FIG. 12 is a partial cross section of a third embodiment of a fuel pump assembly similar in perspective to FIG. 6.

Referring to FIG. 12, a third embodiment of a pump assembly 20" is shown which is similar to the second embodiment except that the protuberance 106' projecting from the finger 116 is replaced with a protuberance 106" which projects radially inward from a sleeve 22".

Figure 13:
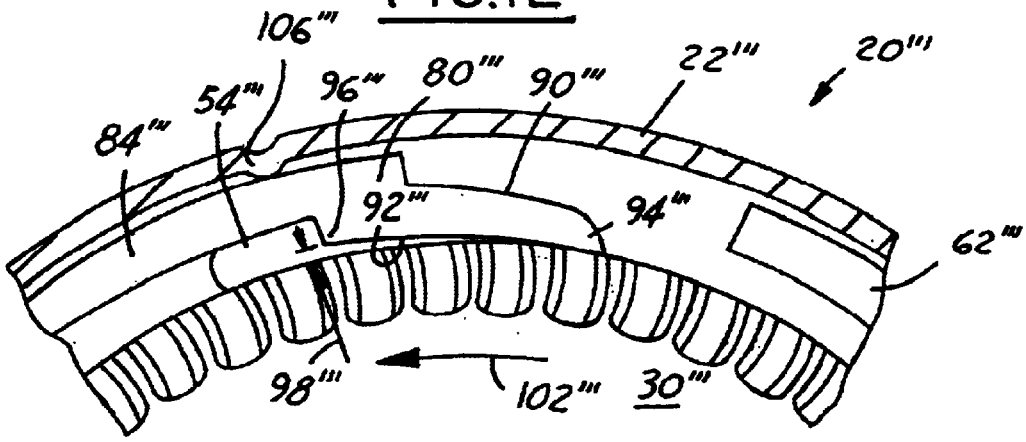
FIG. 13 is a partial cross section of a fourth embodiment of a fuel pump assembly similar in perspective to FIG. 6.

FIG. 13 illustrates a fourth embodiment of a pump assembly 20'" in which the impact segment 82 of the first embodiment is essentially omitted. A stripper segment 80'" of this fourth embodiment carries an impact ramp 90'" having a convex profile (as oppose to the concave profile of the impact wall 90 of the first embodiment). Ramp 90'" extends contiguously from a leading edge or toe 94'", radially outward and circumferentially toward a unitary trailing segment 84'" of the guide ring 62'". A stripper surface 92'" of the stripper segment 80'" extends circumferentially from the leading edge or toe 94'" to a trailing edge or heel 96'". The heel 96'" is spaced radially outward from the impeller 30'" and the toe 94'" is in stripping contact with the impeller 30'" via the protrusion 106'". This profile of the guide ring stripper pad or toe 94'" is contoured such that during operation of the pump 26'" the toe is always urged toward the impeller 30'". This urging is opposite in direction than that of the first embodiment and thus does not depend on the friction caused by the clamping force of the caps 34'", 36'" to the guide ring 62'". Maintaining close contact of the toe 94'" to the impeller results in improved fuel stripping from the impeller yielding increased flow and hot fuel performance. A radial running gap 98'" is always present on the heel 96'" for reasons previously described.

Figure 14:
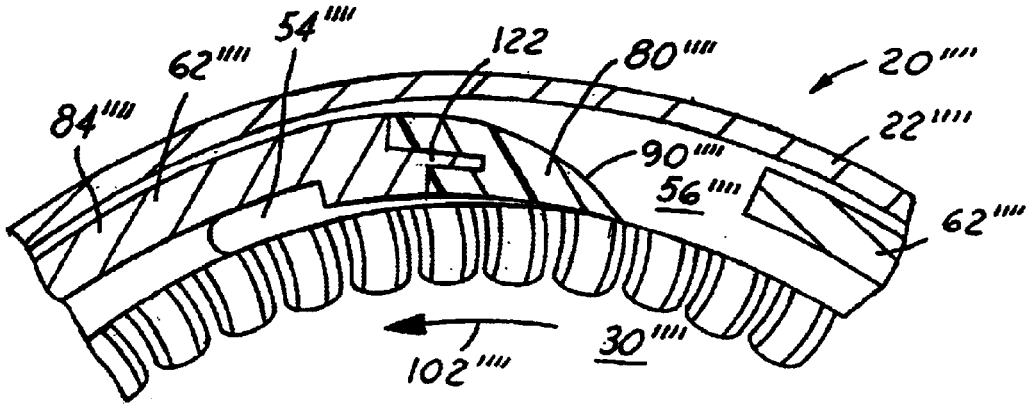
FIG. 14 is a partial cross section of a fifth embodiment of a fuel pump assembly similar in perspective to FIG. 6.

Referring to FIG. 14, a fifth embodiment of a pump assembly 20"" replaces the unitary and homogeneous guide ring 62'" of the fourth embodiment with a trailing segment 84"" made of metal or plastic and a stripper segment 80"" made of a molded resilient rubber material. The molded tip has a pre-established durometer value adjusted for wear and flexibility enhancements. An impact ramp 90"" is carried by the stripper segment 80"" and can thus be molded to include an angle which enhances side discharge designs or matches the best geometry technology. The stripper segment 80"" can be dual injection molded to the plastic trailing portion 84"" or press fitted over a post 122 projecting circumferentially from the end of the trailing portion 84"".

Figure 15:
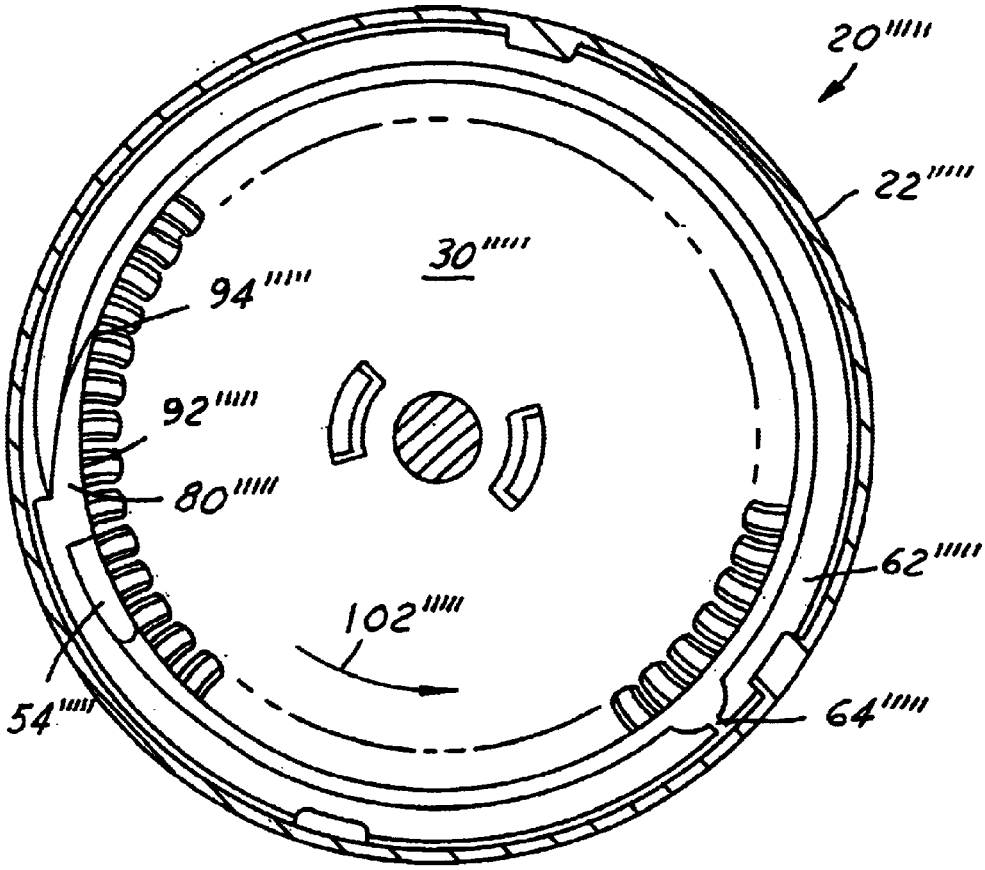
FIG. 15 is a cross section of a sixth embodiment of a fuel pump assembly similar in perspective to FIG. 4.

Referring to FIG. 15, a sixth embodiment of a turbine fuel pump assembly is shown wherein a slit 64"" of a guide ring 62"" is substantially diametrically opposed to a stripper portion 80"" of the guide ring. With this orientation of the slit, a greater area of the stripper surface 92"" can be in contact with an impeller 30"". In other words, a running gap can be reduced or eliminated, when compared to the first embodiment, without lifting a leading edge 94"" away from the impeller 30"" during pump operation.

While the forms of the invention herein disclosed constitute presently preferred embodiments, many others are possible. It is not intended herein to mention all the possible equivalent forms or ramifications of the invention. It is further understood that the terms used herein are merely descriptive rather than limiting, in that various changes may be made without departing from the spirit or scope of this invention as defined by the following claims.

What is claimed is:

1. A turbine fuel pump comprising:

a housing having an inlet port, an outlet port, an impeller cavity and an arcuate channel extending circumferentially from the inlet port to the outlet port, the channel being in lateral communication with the impeller cavity;

an impeller disposed in the impeller cavity and arranged and constructed to rotate within the housing, the impeller having a circumferential array of vanes projecting radially outward and defining an array of pockets communicating radially outward and with the channel;

a guide ring engaged axially to the housing, the guide ring extending circumferentially around the impeller, the guide ring having a stripper segment and a trailing segment, the stripper and trailing segments extending circumferentially about the impeller, the stripper segment being disposed between the inlet and outlet ports, the trailing segment projecting from the stripper segment past the inlet port and toward the outlet port;

a sleeve disposed radially outward from and directly facing the guide ring; and a protuberance constructed and arranged to be in contact between the guide ring and the sleeve, thereby biasing the stripper segment of the guide ring radially inward toward the array of vanes of the impeller.

2. The turbine fuel pump set forth in claim 1 wherein the inlet port is disposed radially outward from the impeller cavity.

3. The turbine fuel pump set forth in claim 1 comprising:

the trailing segment of the guide ring having an inward side defining a radial outward boundary of the channel;

the guide ring having an outward side exposed radially through the housing; and wherein the protuberance is in direct contact with the outward side of the guide ring.

4. The turbine fuel pump set forth in claim 3 wherein the protuberance projects unitarily inward from the sleeve near the inlet and outlet ports.

5. The turbine fuel pump set forth in claim 4 wherein the guide ring has an impact segment projecting circumferentially from the stripper segment toward and defining in-part the outlet port, the stripper segment being engaged circumferentially between the impact and trailing segments.

6. The turbine fuel pump set forth in claim 5 comprising:

the stripper segment having a stripper surface conforming in radius to the impeller and extending circumferentially from a trailing edge to a leading edge, the leading edge being in wetted contact with the array of vanes of the impeller when the pump assembly is running; and the impact segment having an impact ramp extending contiguously from the leading edge of the stripper surface, the impact ramp being constructed and arranged to divert tangential high pressure fuel flow to an axial direction.

7. The turbine fuel pump set forth in claim 6 wherein the impact segment projects circumferentially forward from the stripping segment with respect to the leading edge, and wherein the impact ramp faces generally radially inward and spans forward to the slit.

8. The turbine fuel pump set forth in claim 6 wherein the impact ramp has a concave cross-sectional profile at the outlet port.

9. The turbine fuel pump set forth in claim 6 wherein the guide ring has a slit separating the impact segment from the trailing segment.

10. The turbine fuel pump set forth in claim 9 wherein the slit is disposed at the outlet port.

11. The turbine fuel pump set forth in claim 6 comprising:

the array of vanes of the impeller being one of two array of vanes disposed concentrically to one another and separated axially by a continuous circumferential rib projecting radially outward and flush with both arrays of vanes, the rib of the impeller being in wetted contact with the leading edge of the striper segment;

the trailing segment of the guide ring having a rib projecting radially inward and extending circumferentially from a low pressure end disposed close to the inlet port and a high pressure end disposed close to the outlet port, the rib of the trailing segment being axially aligned and directly adjacent to the rib of the impeller; and wherein the protuberance of the sleeve is circumferentially disposed away from the rib of the trailing segment.

12. The turbine fuel pump set forth in claim 11 wherein the guide ring has a slit disposed at the outlet port and separating the impact segment from the trailing segment.

13. The turbine fuel pump set forth in claim 12 wherein the trailing edge of the stripper surface has a running gap spanning radially between the two array of vanes and the stripper surface.

14. The turbine fuel pump set forth in claim 13 wherein the leading edge of the stripper surface is a toe and the trailing edge is a heel, and wherein the impact ramp has a convex cross-sectional profile extending contiguously from the toe, radially outward from the stripper surface and circumferentially toward the heel.

15. The turbine fuel pump set forth in claim 14 wherein the impact segment and the stripper segment are unitary and made of a molded resilient rubber.

16. The turbine fuel pump set forth in claim 15 wherein the impact segment and the stripper segment are press fitted to the trailing segment.

17. The turbine fuel pump set forth in claim 16 wherein the impact segment and the stripper segment are injection molded to the trailing segment which is plastic.

18. A turbine fuel pump comprising:

a housing having an inlet port, an outlet port, an impeller cavity and an arcuate channel extending circumferentially from the inlet port to the outlet port, the channel being in lateral communication with the impeller cavity;

an impeller disposed in the impeller cavity and arranged and constructed to rotate within the housing, the impeller having a circumferential array of vanes projecting radially outward and defining an array of pockets communicating radially outward and with the channel;

a guide ring engaged axially to the housing, the guide ring extending circumferentially around the impeller, the guide ring having a stripper segment and a trailing segment, the stripper and trailing segments extending circumferentially about the impeller, the stripper segment being disposed between the inlet and outlet ports, the trailing segment projecting from the stripper segment past the inlet port and toward the outlet port;

a sleeve disposed radially outward from and directly facing the guide ring;

a protuberance constructed and arranged to be in contact between the guide ring and the sleeve, thereby biasing the stripper segment of the guide ring radially inward toward the array of vanes of the impeller;

the trailing segment of the guide ring having an inward side defining a radial outward boundary of the channel;

the guide ring having an outward side exposed radially through the housing;

wherein the protuberance is in direct contact with the outward side of the guide ring;

wherein the protuberance projects unitarily inward from the sleeve near the inlet and outlet ports;

wherein the guide ring has an impact segment projecting circumferentially from the stripper segment toward and defining in part the outlet port, the stripper segment being engaged circumferentially between the impact and trailing segments;

the stripper segment having a stripper surface conforming in radius to the impeller and extending circumferentially from a trailing edge to a leading edge, the leading edge being in wetted contact with the array of vanes of the impeller when the pump assembly is running;

the impact segment having an impact ramp extending contiguously from the leading edge of the stripper surface, the impact ramp being constructed and arranged to divert tangential high pressure fuel flow to an axial direction;

wherein the guide ring has a slit separating the impact segment from the trailing segment; and wherein the slit is disposed substantially diametrically away from the outlet port.

19. A turbine fuel pump comprising:

a housing having an inlet port, an outlet port, an impeller cavity and an arcuate channel extending circumferentially from the inlet port to the outlet port, the channel being in lateral communication with the impeller cavity;

an impeller disposed in the impeller cavity and arranged and constructed to rotate within the housing, the impeller having a circumferential array of vanes projecting radially outward and defining an array of pockets communicating radially outward and with the channel;

a guide ring engaged axially to the housing, the guide ring extending circumferentially around the impeller, the guide ring having a stripper segment and a trailing segment, the stripper and trailing segments extending circumferentially about the impeller, the stripper segment being disposed between the inlet and outlet ports, the trailing segment projecting from the stripper segment past the inlet port and toward the outlet port;

a sleeve disposed radially outward from and directly facing the guide ring;

a protuberance constructed and arranged to be in contact between the guide ring and the sleeve, thereby biasing the stripper segment of the guide ring radially inward toward the array of vanes of the impeller;

the trailing segment of the guide ring having an inward side defining a radial outward boundary of the channel;

the guide ring having an outward side exposed radially through the housing;

wherein the protuberance is in direct contact with the outward side of the guide ring;

wherein the protuberance projects unitarily inward from the sleeve near the inlet and outlet ports; and wherein the outward side of the guide ring defines a cantilevered finger extended circumferentially, the finger being in contact with and biased radially inward by the protuberance.

20. A turbine fuel pump comprising:

a housing having an inlet port, an outlet port, an impeller cavity and an arcuate channel extending circumferentially from the inlet port to the outlet port, the channel being in lateral communication with the impeller cavity;

an impeller disposed in the impeller cavity and arranged and constructed to rotate within the housing, the impeller having a circumferential array of vanes projecting radially outward and defining an array of pockets communicating radially outward and with the channel;

a guide ring engaged axially to the housing, the guide ring extending circumferentially around the impeller, the guide ring having a stripper segment and a trailing segment, the stripper and trailing segments extending circumferentially about the impeller, the stripper segment being disposed between the inlet and outlet ports, the trailing segment projecting from the stripper segment past the inlet port and toward the outlet port;

a sleeve disposed radially outward from and directly facing the guide ring;

a protuberance constructed and arranged to be in contact between the guide ring and the sleeve, thereby biasing the stripper segment of the guide ring radially inward toward the array of vanes of the impeller;

the trailing segment of the guide ring having an inward side defining a radial outward boundary of the channel;

the guide ring having an outward side exposed radially through the housing;

wherein the protuberance is in direct contact with the outward side of the guide ring; and wherein the outward side of the guide ring defines a cantilevered finger extended circumferentially, the protuberance projecting radially outward from the finger and being in resilient contact with the sleeve.

21. A calibration ring tool for calibrating a turbine fuel pump assembly having a cantilevered stripper segment of a guide ring being in radial contact with an array of vanes projecting radially outward from an impeller surrounded by the guide ring, the guide ring being exposed directly radially inward from a surrounding sleeve of the pump assembly, the calibration ring tool comprising:

a base having a bore, the turbine fuel pump assembly placed within the bore; and a calibration screw having a tip, the screw being threaded laterally through the base with the tip projecting adjustably into the bore for creating a dimple on the sleeve of the pump assembly which creates a corresponding projection that contacts the guide ring to move the stripper segment toward the array of vanes of the impeller.

22. The calibration ring tool set forth in claim 21 wherein the calibration screw is a servo-controlled ball screw.

23. A method of calibrating a turbine fuel pump assembly comprising the steps of:

aligning a calibration screw of a calibration ring tool axially and circumferentially to an outer sleeve of the fuel pump assembly;

threading a screw into the calibration ring tool, thereby creating a dimple into the sleeve and a corresponding protuberance projecting into the pump assembly against a guide ring of the pump assembly;

continuing to laterally thread the screw inward toward the sleeve, thereby enlarging the protuberance which contacts and moves a stripper segment of the guide ring radially inward toward an impeller of the fuel pump assembly;

monitoring current draw increase of a motor of the pump assembly; and stopping rotation of the calibration screw when the current reaches a pre-established value.

24. The method of calibrating a turbine fuel pump assembly set forth in claim 23 comprising the further step of inserting the pump assembly into a bore carried by a base of the calibration ring tool as a means of aligning the calibration screw axially to the fuel pump assembly and wherein the calibration screw is threaded laterally into the base.

25. The method of calibrating a turbine fuel pump assembly set forth in claim 24 comprising the further step of rotating the calibration screw laterally outward to release the pump assembly from the calibration ring tool.

26. The method of calibrating a turbine fuel pump assembly set forth in claim 25 comprising the further steps of sending an electrical signal from a controller to a servo motor of the calibration screw to rotationally drive the screw into the base of the calibration ring tool.

27. The method of calibrating a turbine fuel pump assembly set forth in claim 26 comprising the further step of sending an electrical signal from the controller to the servo motor of the calibration screw to rotationally drive the screw partway out of the base to release the fuel pump assembly from the calibration ring tool.

28. A turbine fuel pump comprising:

a lower cap;

an upper cap;

an impeller disposed rotatably and axially between the upper and lower caps;

a resilient guide ring fitted snugly and circumferentially about the impeller during assembly and then compressed axially between the upper and lower caps, the guide ring having a stripper segment which carries a circumferentially extending stripper surface facing radially inward toward the impeller and spanning between trailing and leading edges of the stripper segment;

a diminishing gap defined between the stripper surface and the impeller;

wherein the leading edge is in wetted contact with the impeller during pump operation; and wherein the trailing edge is spaced radially outward from the impeller.

29. The turbine fuel pump set forth in claim 28 comprising:

an encompassing sleeve disposed radially outward from the lower cap, the upper cap and the guide rings;

a protuberance of the sleeve projecting radially inward to urge the leading edge of the stripper segment into wetted contact with the impeller for improved pump operating efficiency; and wherein the protuberance is formed during pump operation with the impeller rotating.

30. The turbine fuel pump set forth in claim 29 comprising:

a circumferential clearance disposed radially between the sleeve and the guide ring; and wherein the protuberance is a permanent deformation and projects radially inward through the clearance to contact the guide ring.

31. The turbine fuel pump set forth in claim 30 wherein the protuberance has a corresponding dimple carried by the sleeve.

* * * * *